United States Patent [19]

Ozawa et al.

[11] Patent Number: 4,945,565

[45] Date of Patent: Jul. 31, 1990

[54] LOW BIT-RATE PATTERN ENCODING AND DECODING WITH A REDUCED NUMBER OF EXCITATION PULSES

[75] Inventors: Kazunori Ozawa; Takashi Araseki, both of Tokyo, Japan

[73] Assignee: NEC Corporation, Tokyo, Japan

[21] Appl. No.: 751,818

[22] Filed: Jul. 5, 1985

[30] Foreign Application Priority Data

Jul. 5, 1984 [JP] Japan ..... 59-139634
Jul. 10, 1984 [JP] Japan ..... 59-143017

[51] Int. Cl.[5] ..... G10L 7/02
[52] U.S. Cl. ..... 381/38
[58] Field of Search ..... 381/36–41, 381/29–35, 51–53, 49; 364/513.5

[56] References Cited

U.S. PATENT DOCUMENTS

| | | | |
|---|---|---|---|
| 3,467,783 | 9/1969 | Magnuski | 381/30 |
| 3,659,052 | 4/1972 | Slavin | 381/29 |
| 4,220,819 | 9/1980 | Atal | 381/38 |
| 4,301,329 | 11/1981 | Taguchi | 381/37 |
| 4,618,982 | 10/1986 | Horvath et al. | 381/36 |
| 4,669,120 | 5/1987 | Ono | 381/40 |
| 4,701,954 | 10/1987 | Atal | 381/49 |
| 4,709,390 | 11/1987 | Atal et al. | 364/513.5 |
| 4,720,865 | 1/1988 | Taguchi | 381/49 |

OTHER PUBLICATIONS

Max–"Quantizing for Minimum Distortion", Joel Max, pp. 7–12, 1960.

IEEE Transactions on Acoustics Speech and Signal Processing, "Real-Time Domain Harmonic Scaling of Speech for Rate Modification and Coding"; vol. ASSP 31, No. 1, Feb. 1983, R. Cox et al.

*Primary Examiner*—Gary V. Harkcom
*Assistant Examiner*—John A. Merecki
*Attorney, Agent, or Firm*—Sughrue, Mion, Zinn, Macpeak & Seas

[57] ABSTRACT

In an encoder operable in response to a discrete pattern signal divisible into a succession of segments to produce an output code sequence, a pitch parameter and a spectral parameter are extracted in a parameter calculator from each segment and from a spectral interval. In an excitation pulse producing circuit, each spectral interval is divided into a plurality of subframes, namely, pitch periods with reference to the pitch parameter to divide each segment. A minor group of excitation pulses is calculated from the segment at every subframe to form a major group of the excitation pulses in the spectral interval. The excitation pulses of the major group are reduced in number with reference to adjacent ones of the minor groups in each spectral interval and are modified into a succession of modified excitation pulses. The modified excitation pulses are combined with the spectral parameter into the output code sequence. In a decoder, the modified excitation pulses and the spectral parameter are extracted from the output code sequence. The pitch parameter is recovered by the use of the extracted and mofified excitation pulses and is used to produce a reproduction of the discrete pattern signal. Alternatively, the pitch parameter may be sent from the encoder together with the spectral parameter and the modified excitation pulses as the output code sequence and extracted from the output code sequence in the decoder.

7 Claims, 8 Drawing Sheets

LOW BIT-RATE PATTERN ENCODING AND DECODING WITH A REDUCED NUMBER OF EXCITATION PULSES

BACKGROUND OF THE INVENTION

This invention relates to a low bit-rate pattern encoding method and a device therefor. The low bit-rate pattern encoding method or technique is for encoding an original pattern signal into an output code sequence of an information transmission rate of less than about 16 kbit/sec. The pattern signal may either be a speech or voice signal. The output code sequence is either for transmission through a transmission channel or for storage in a storing medium.

This invention relates also to a method of decoding the output code sequence into a reproduced pattern signal, namely, into a reproduction of the original pattern signal, and to a decoder for use in carrying out the decoding method. The output code sequence is supplied to the decoder as an input code sequence and is decoded into the reproduced pattern signal by synthesis. The pattern encoding is useful in, among others, speech synthesis.

Speech encoding based on a multi-pulse excitation method is proposed as a low bit-rate speech encoding method in an article which is contributed by Bishnu S. Atal et al of Bell Laboratories to Proc. IASSP, 1982, pages 614–617, under the title of "A New Model of LPC Excitation for Producing Natural-sounding Speech at Low Bit Rates." According to the Atal et al article, a discrete speech signal, namely, a digital signal sequence is divided into a succession of segments each of which has a spectral interval, such as a frame. Each segment is converted into a sequence or train of excitation or exciting pulses by the use of a linear predictive coding (LPC) synthesizer. Instants or locations of the excitation pulses and amplitudes thereof are determined by the so-called analysis-by-synthesis (A-b-S) method. In this method, a spectral parameter should be calculated for every segment to specify a short-time envelope of the speech signal and to control the LPC synthesizer. It is believed that the model of Atal et al is prosperous as a model of encoding at a bit rate between about 8 and 16 kbit/sec the discrete speech signal sequence which is derived from an original speech signal. The model, however, requires a great amount of calculation in determining the pulse instants and the pulse amplitudes. A great deal of calculation is also required in decoding the excitation pulses into the digital signal sequence. For simplicity of description, the above-mentioned encoding and decoding will collectively be called conversion hereinafter.

In the meanwhile, a "voice coding system" is disclosed in U.S. Pat. No. 4,716,592 by Kazunori Ozawa et al, the instant applicants, and assigned to the present assignee ("the Ozawi et al patent"). The voice or speech encoding system of the Ozawa et al patent application is for encoding a discrete speech signal sequence of the type described into an output code sequence, which is for use in a decoder in exciting either a synthesizing filter or its equivalent of the type of the LPC synthesizer in producing a reproduction of the original speech signal as a reproduced speech signal.

More specifically, the speech encoding system of the Ozawa et al patent application comprises a parameter calculator responsive to each segment of the discrete speech signal sequence for calculating a parameter sequence representative of a spectral envelope of the segment. Responsive to the parameter sequence, an impulse response calculator calculates an impulse response sequence which the synthesizing filter has for the segment. In other words, the impulse response calculator calculates an impulse response sequence related to the parameter sequence. An autocorrelator or covariance calculator calculates an autocorrelation or covariance function of the impulse response sequence. Responsive to the segment and the impulse response sequence, a cross-correlator calculates a cross-correlation function between the segment and the impulse response sequence. Responsive to the autocorrelation and the cross-correlation functions, an excitation pulse sequence producing circuit produces a sequence of excitation pulses by successively determining instants and amplitudes of the excitation pulses. A first coder codes the parameter sequence into a parameter code sequence. A second coder codes the excitation pulse sequence into an excitation pulse code sequence. A multiplexer multiplexes or combines the parameter code sequence and the excitation pulse code sequence into the output code sequence.

With the system according to the Ozawa et al patent, instants of the respective excitation pulses and amplitudes thereof are determined or calculated with a drastically reduced amount of calculation. It is to be noted in this connection that the pulse instants and the pulse amplitudes are calculated assuming that the pulse amplitudes are dependent solely on the respective pulse instants. The assumption is, however, not applicable in general to actual original speech signals, from each of which the discrete speech signal sequence is derived.

It is well known that a female voice has a high pitch as compared with a male voice. This means that a greater number of pitch pulses appear in the female voice than in the male voice within each segment. Inasmuch as the excitation pulses are determined in relation to the pitch pulses, a high-pitch voice is encoded into the excitation pulses greater in number than a low-pitch voice. Therefore, the high-pitch voice can not faithfully be encoded in comparison with the low-pitch voice when the excitation pulses are transmitted at the low bit rate. Anyway, the original speech signal is specified not only by a short-time spectral envelope but also pitches.

SUMMARY OF THE INVENTION:

It is an object of this invention to provide a method which is capable of carrying out conversion between a discrete pattern signal sequence, such as a digital speech signal sequence, and an output signal sequence with a small amount of calculation and with a high fidelity or faithfulness.

It is another object of this invention to provide a method of the type described, wherein the output signal sequence is transmissible at a low bit rate without a reduction of the high fidelity.

It is still another object of this invention to provide an encoder which is for use in encoding a digital signal sequence into an output signal sequence with a small amount of calculation and with a high faithfulness.

It is yet another object of this invention to provide a decoder which is for use in combination with an encoder of the type described.

According to this invention, a method is disclosed for encoding a discrete pattern signal into an output code sequence and for decoding the output code sequence into a reproduction of the discrete pattern signal. The discrete pattern signal is divisible into a succession of segments. The method comprises the steps of extracting a pitch parameter and a spectral parameter from each segment and from a spectral interval which is not shorter than the segment, respectively, and dividing the spectral interval into a succession of pitch intervals in consideration of the pitch parameters extracted from the respective segments. Each pitch interval is shorter than the segment. The method comprises the steps of processing the discrete pattern signal at each of the pitch intervals into a minor group of excitation pulses in response to the spectral parameter extracted in the spectral interval which includes each pitch interval to determine a major group of excitation pulses for said each segment, reducing the excitation pulses of the major group in number into a succession of modified excitation pulses with reference to the excitation pulses of the minor groups which each segment comprises, and producing the output code sequence in response to the spectral parameters extracted from the respective spectral intervals and to the successions of modified excitation pulses into which the major-group excitation pulses determined for the respective segments are reduced. The method further comprises the steps of separating the output code sequence into transmission parameters and transmission pulses corresponding to the spectral parameters and the modified excitation pulses in response to which the output code sequence is produced, processing the transmission pulses into processed pulses, and producing the reproduction of the discrete pattern signal in response to the transmission parameters and the processed pulses.

Figure 1:
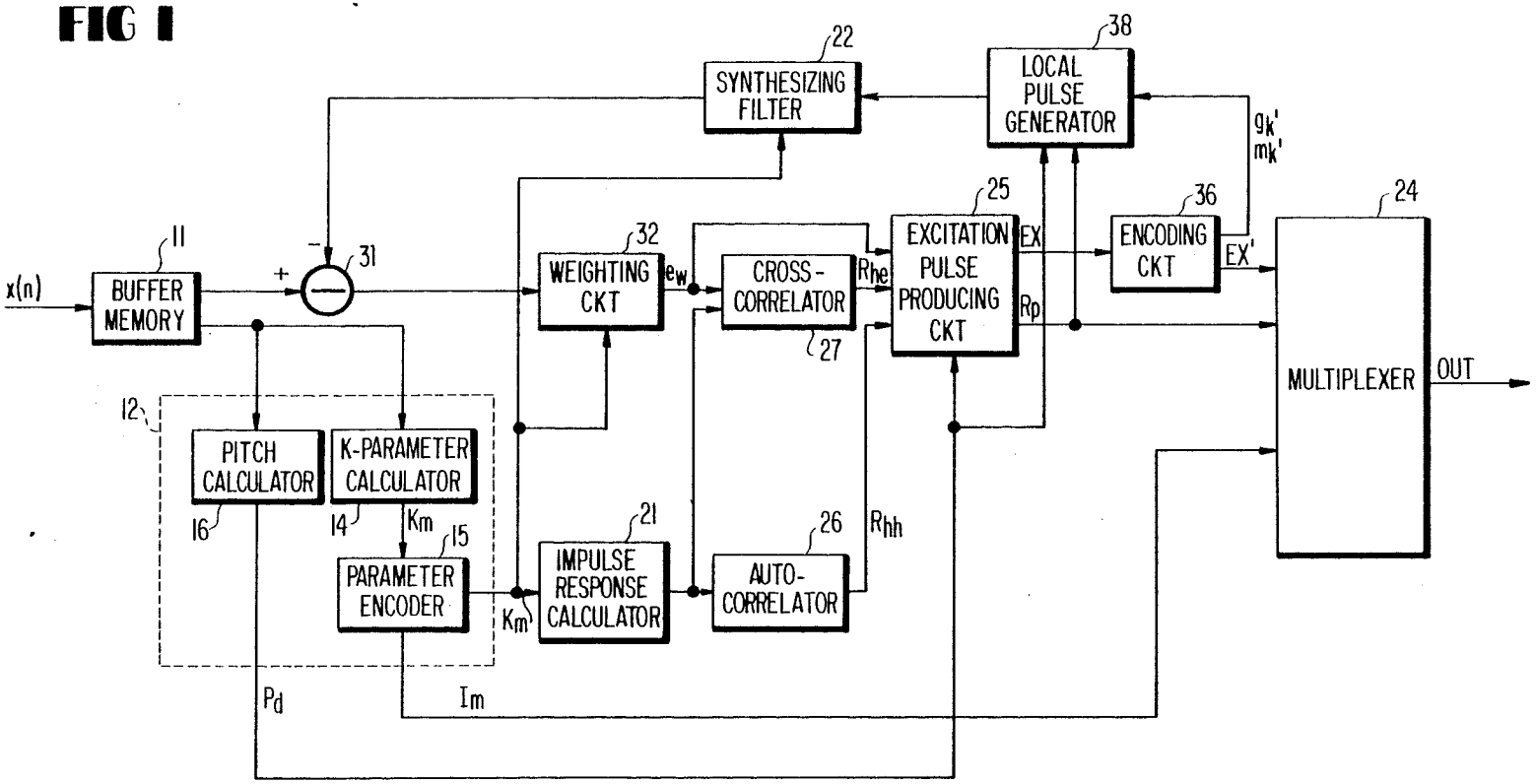
FIG. 1 is a block diagram of an encoder according to a first embodiment of this invention.

DESCRIPTION OF THE PREFERRED EMBODIMENTS:

Referring to FIG. 1, an encoder according to a first embodiment of this invention is for use in encoding a digital signal sequence, namely, discrete pattern signal sequence x(n) into an output code sequence OUT. The digital code sequence x(n) is derived from an original pattern signal, such as a speech signal, in a known manner and is divisible into a plurality of segments each of which is arranged within a spectral interval, such as a frame of 20 milliseconds, and which comprises a predetermined number of samples. The spectral interval may be longer than each segment. It is possible to specify the original pattern signal by a short-time spectral envelope and pitches. The pitches have a pitch period or pitch interval shorter than the segment. The original pattern signal is assumed to be sampled at a sampling frequency of 8 kHz into the digital signal sequence.

Each segment is stored in a buffer memory 11 and is sent to a parameter calculator 12. It is assumed that each segment is represented by zeroth through (N−1)−th samples, where N is equal to one hundred and sixty under the circumstances. The segment will be designated by s(n), where n represents zeroth through (N−1)−th sampling instants 0, . . . , n, . . . , and (N−1).

The illustrated calculator 12 comprises a K parameter calculator 14 for calculating a sequence of K parameters representative of the short-time spectral envelope of the segment s(n). The K parameters will be referred to as spectral parameters in the instant specification and are called reflection coefficients in the above-referenced Atal et al article and will herein be denoted by $K_m$ where m represents a natural number between 1 and M, both inclusive. The K parameter sequence will be designated by the symbol $K_m$. It is possible to calculate the K parameters in the manner described in an article which is contributed by R. Viswanathan et al to IEEE Transactions on Acoustics, Speech, and Signal Processing, June, 1975, pages 309–321, and entitled "Quantization Properties of Transmission Parameters in Linear Predictive Systems."

Let the K parameters $K_m$ be calculated with reference to an autocorrelation function R(m) of an input signal, squared prediction errors E, and first through M-th prediction coefficients $a_l$ to $a_M$. Each prediction coefficient a has an order which is specified by a superscript m. More specifically, the K parameters $K_m$ can recursively be calculated by the following equations:

$$E_0 = R(0),$$

$$K_m = -\left[ R(m) + \sum_{j=1}^{m-1} a_j^{(m-1)} R_{m-j} \right] / E_{m-1},$$

$$a_m^{(m)} = K_m,$$

$$a_j^{(m)} = a_j^{(m-l)} + K_m \cdot a_{m-j}^{(m-j)}, \ (l \leqq j \leqq m-l)$$

$$E_m = (1 - K_m^2) E_{m-l}, \text{ and}$$

$$a_j = a_j^{(M)}, \ (l \leqq j \leqq M),$$

where $E_m$ is representative of the squared prediction error appearing on prediction of the prediction coefficients of the order m. A normalized prediction error $V_m$ is represented by:

$$V_m = E_m / R(0).$$

When m=M, the normalized prediction error VM is given by:

$$V_M = \prod_{m=1}^{M} (1 - K_m^2).$$

From the above-mentioned equation, it is readily understood that the normalized prediction error $V_M$ can be monitored, if the K parameters are given. At any rate, the above-mentioned algorithm may be called Viswanathan's algorithm.

A K parameter encoder 15 is for encoding the parameter sequence $K_m$ into a K parameter code sequence $I_m$ of a predetermined number of quantization bits. The encoder 15 may be of circuitry described in the above-mentioned article contributed by R. Viswanathan et al. The encoder 15 furthermore decodes the first parameter code sequence $I_m$ into a sequence of decoded K parameters $K_m'$ which are in correspondence to the respective K parameters $K_m$. The decoded K parameter sequence $K_m'$ is delivered to an impulse response calculator 21 and a synthesizing circuit 22 both of which will be described later while the decoded code sequence $I_m$ is sent to a multiplexer 24 which will be also described later. It suffices to say that the synthesizing filter 22 has an order of M described in conjunction with the K parameters.

The illustrated calculator 12 further comprises a pitch calculator 16 for calculating a pitch parameter representative of the pitch period within each frame in response to each segment to produce a pitch period signal Pd representative of the pitch period. The calculation of the pitch period can be carried out in accordance with a manner described in an article contributed by R. V. Cox et al to IEEE Transactions on Acoustics, Speech, and Signal Processing, February 1983, pages 258–272, and entitled "Real-time Implementation of Time Domain Harmonic Scaling of Speech for Rate Modification and Coding." Briefly, the pitch period can be calculated by the use of an autocorrelation of each segment. Any other known methods may be used to calculate the pitch period Pd. For example, the pitch period can be calculated from a prediction error signal appearing after prediction of the segment in the known manner.

The pitch period signal Pd is delivered to an excitation pulse producing circuit 25 to be processed in a manner to be described presently.

Responsive to the decoded K parameter sequence $K_m'$, the impulse response calculator 21 calculates a sequence of weighted impulse responses $h_w(n)$ which is representative of a weighted transfer function of the synthesizer filter 22. The weighted transfer function $h_w(n)$ is represented by $H_w(z)$ when subjected to z-transform and is given by:

$$H_w(z) = W(z)/\left(1 - \sum_{m=1}^{M} K_m' \cdot z^{-m}\right),$$

where M is representative of the order of the prediction coefficients and W(z) is representative of a z-transform of weights. The z-transform W(z) of the weights is given by:

$$W(z) = \left(1 - \sum_{m=1}^{M} a_m z^{-m}\right)/\left(1 - \sum_{m=1}^{M} a_m r^m z^{-m}\right),$$

where r represents a constant which has a value preselected between 0 and 1, both inclusive, and $a_m$ represents the prediction coefficients of the synthesizing filter 22. The constant r determines a frequency characteristic of the z-transform in the manner which will be exemplified in the following.

By way of example, let the constant r be equal to unity. The z-transform W(z) becomes identically equal to unity and has a flat frequency characteristic. When the constant r is equal to zero, the z-transform W(z) gives an inverse of the frequency characteristic of the synthesizing filter. In the manner discussed in detail in the Atal et al article, selection of the value of the constant r is not critical. For the sampling frequency of the above-exemplified 8 kHz, 0.8 may typically be selected for the constant r. The weights w(n) are for minimizing an auditory sensual difference between the original speech signal and the reproduced speech signal.

The weighted impulse responses $h_w(n)$ are sent to both of an autocorrelator (or covariance calculator) 26 and a cross-correlator 27. The autocorrelator 26 is for use in calculating an autocorrelation or covariance function or coefficient $R_{hh}$ of the weighted impulse response sequence $h_w(n)$ for a predetermined delay time $\tau$. The autocorrelation function $R_{hh}(\tau)$ is given by:

$$R_{hh}(\tau) = \sum_{N=1}^{N-\tau} h_w(n) \cdot h_w(n+\tau), \tag{1}$$

and is sent to the excitation pulse producing circuit 25 as an autocorrelation signal $R_{hh}$.

On the other hand, each segment is delivered from the buffer memory 11 to a subtractor 31 which is supplied with an output sequence from the synthesizing filter 22. The subtractor 31 subtracts the output sequence from each segment for each frame to produce a sequence of errors e(n).

The result e(n) of subtraction is given to a weighting circuit 32 which is operable in response to the decoded K parameter sequence $K_m'$. The weighting circuit 32 weights the error sequence e(n) by weights w(n) which are dependent on the frequency characteristic of the synthesizing filter 22. A sequence of weighted errors $e_w(n)$ is written into $E_w(z)$ by the use of z-transform representation. The z-transform of the weighted errors is given by:

$$E_w(z) = E(z) \cdot W(z),$$

where E(z) and W(z) are representative of z-transforms of e(n) and w(n), respectively.

The weighted errors $e_w(n)$ are delivered to both of the cross-correlator 27 and the excitation pulse producing circuit 25 as a weighted error signal $e_w$.

The cross-correlator 27 calculates a cross-correlation function or coefficient $R_{he}(n_x)$ between the weighted error sequence $e_w(n)$ and the weighted impulse response sequence $h_w(n)$ for a predetermined number N of samples in accordance with the following equation:

$$R_{he}(n_x) = \sum_{n=1}^{N} e_w(n) \cdot h_w(n - n_x), \tag{2}$$

where $n_x$ is an integer selected between unity and N, both inclusive.

The calculated cross-correlation function $R_{he}(n_x)$ is sent to the excitation pulse producing circuit 25 as a cross-correlation signal $R_{he}$.

Now, the excitation pulse producing circuit 25 is operable in response to the pitch period Pd, the autocorrelation signal $R_{hh}$, the cross-correlation signal $R_{he}$, and the weighted error signal $e_w$ to produce a sequence of excitation pulses in a manner to be described later. The illustrated excitation pulse producing circuit 25 may be a signle chip microprocessor for processing a signal.

Figure 2:
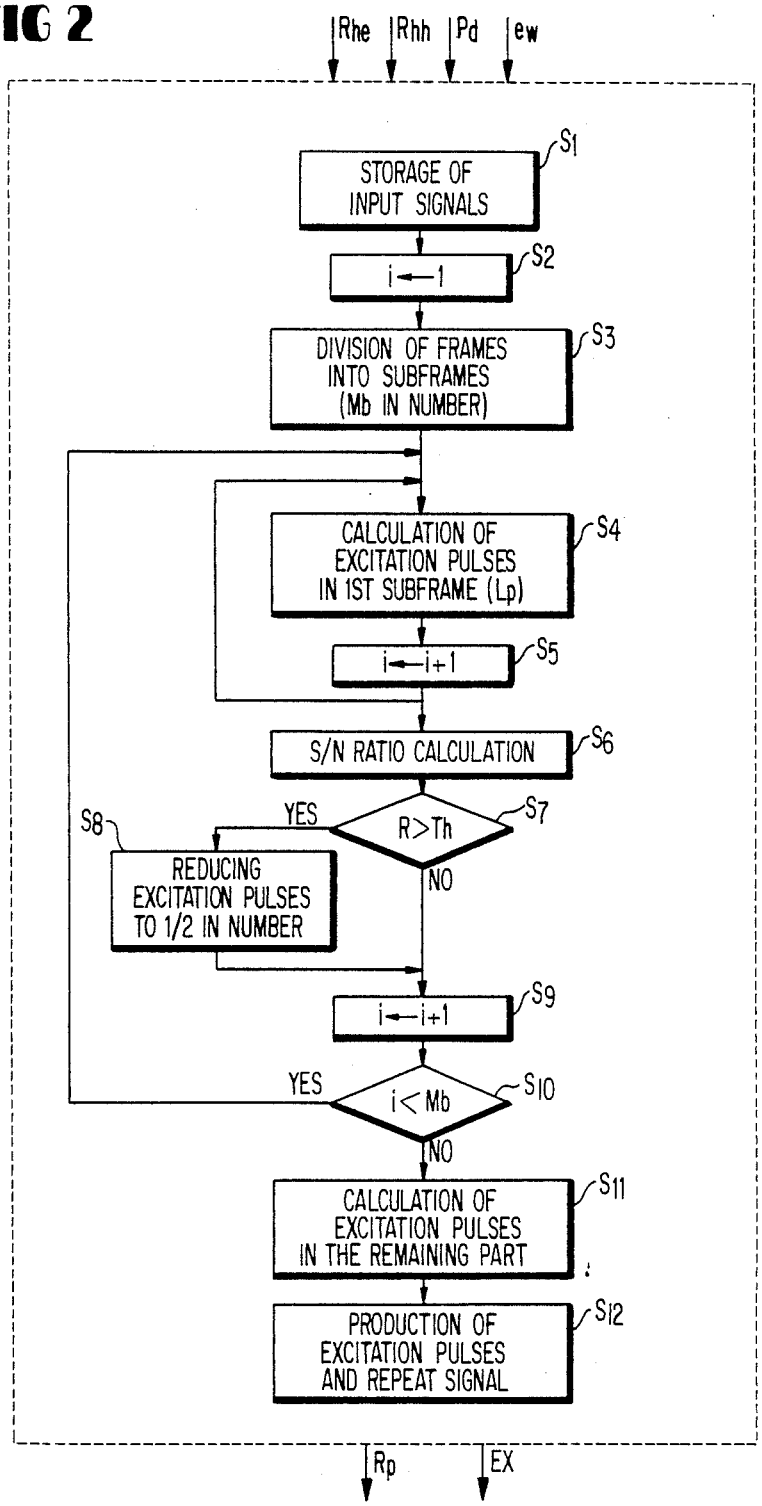
FIG. 2 is a flow chart for use in describing operation of the encoder illustrated in FIG. 1.

Referring to FIG. 2 together with FIG. 1, the excitation pulse producing circuit 25 comprises a central processing unit, a program memory, an arithmetic logic unit, a plurality of registers, and a data memory, in the manner well known in the art. At a first step $S_1$, the pitch period signal Pd, the weighted error signal $e_w$, the cross-correlation signal $R_{he}$, and the autocorrelation signal $R_{hh}$ are stored as input signals in the data memory.

Subsequently, a variable i is made to be equal to unity at a second step $S_2$. The variable i will be called a subframe index as will become clear as the description proceeds. The frame for the input signals is equally divided with reference to the pitch period signal Pd at a third step $S_3$ into a plurality of subframes. In this event, it is assumed that the pitch period is invariable within each frame and that the subframes are equal in number to Mb. Inasmuch as the fame is not completely divided by the pitch period, it may be separated into a subframe part and the remaining part. Such division of the frame can readily be possible by the use of the arithmetic logic unit and the registers under control of a program read out of the program memory. Therefore, the arithmetic logic unit and the registers may be called a division circuit for dividing each frame.

It is also assumed that the number of the excitation pulses is equal to $L_B$ in each frame and that the numbers of the excitation pulses to be produced in each subframe and the remaining part of each frame are equal to $L_P$ and $L_R$, respectively. The excitation pulses to be produced within each frame are called a major group of the excitation pulses while the excitation pulses to be produced in each subframe are called a minor group of the excitation pulses. The number $L_B$ of the excitation pulses in the major group is given by:

$$L_B = M \cdot L_P + L_R. \tag{3}$$

At the third step $S_3$, the numbers $L_P$ and $L_R$ are also calculated in accordance with Equation (3).

The third step $S_3$ is followed by a fourth step $S_4$. As shown at the second step $S_2$, the variable i is equal to unity and is representative of a first one of the subframes. Under the circumstances, the excitation pulses are calculated at the fourth step $S_4$ in connection with the first subframe to form the minor group of the excitation pulses. The calculation of the excitation pulses is recursively carried out in accordance with the following equation:

$$g_k(m_k) = \left[ R_{he}(m_k) - \sum_{j=1}^{k-1} g_j \cdot R_{hh}(|m_j - m_k|) \right] / R_{hh}(0), \tag{4}$$

where k is an integer between unity and $L_P$, both inclusive and $g_k$ and $m_k$ are representative of an amplitude and a pulse instant or position of a k-th excitation pulse.

Figure 3:
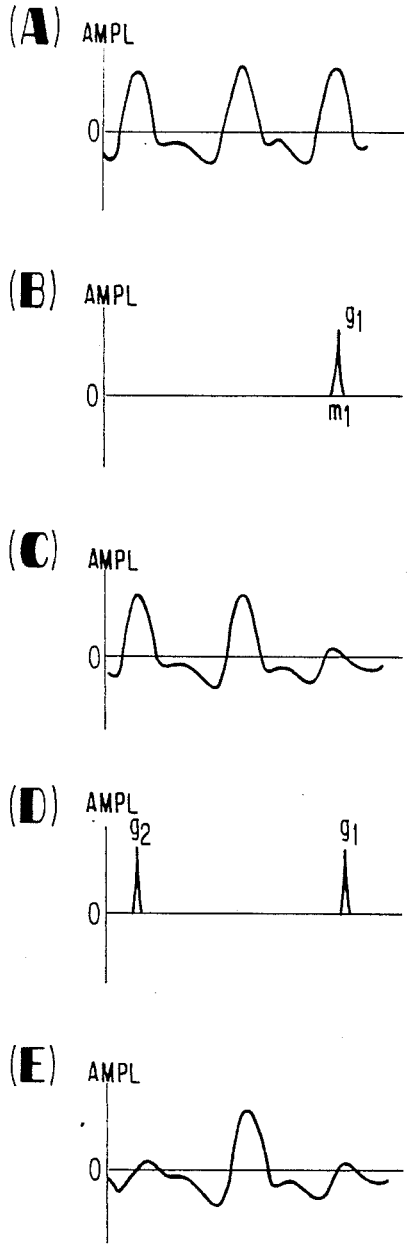
FIGS. 3(A) through (E) are time charts for use in describing operation successively carried out in a subframe in the encoder illustrated in FIG. 1.

Referring to FIG. 3 together with FIG. 1, let the cross-correlator 27 produce the cross-correlation signal $R_{he}$ for the first subframe, as illustrated in FIG. 3(A). The excitation pulse producing circuit 25 at first calculates a first one $g_l$ of the excitation pulses in compliance with Equation (4) and a first one $m_l$ of the instants, as shown in FIG. 3(B), in a manner described in the Ozawa et al patent referenced in the Background section of the instant specification. After calculation of the first excitation pulse $g_l$ and its instant $m_l$, an influence resulting from the first excitation pulse $g_l$ is subtracted from the cross-correlation signal $R_{he}$. As a result, the cross-correlation signal $R_{he}$ is changed from a waveform illustrated in FIG. 3(A) to another waveform illustrated in FIG. 3(C).

Subsequently, a second one $g_2$ of the excitation pulses and a second instant thereof are calculated by the use of Equation (4) in the above-mentioned manner, as shown in FIG. 3(D). When an influence of the second excitation pulse $g_2$ is removed from the cross-correlation signal $R_{he}$, the cross-correlation signal $R_{he}$ is changed to a waveform as shown in FIG. 3(E). Likewise, the excitation pulses is repeatedly determined within the first subframe until the number of the excitation pulses becomes equal to $L_P$.

Turning back to FIG. 2, the fourth step $S_4$ is succeeded by a fifth step $S_5$ to increase the variable i by one and is thereafter returned back to the fourth step $S_4$ to calculate the excitation pulses in connection with a second one of the subframes in the above-mentioned manner. Thus, the excitation pulses are calculated about two adjacent ones of the subframes.

Thereafter, the fifth step $S_5$ is followed by a sixth step $S_6$ at which signal-to-noise (S/N) ratios are calculated about the first and the second subframes. The signal-to-noise ratios are given by:

$$S/N = Ree(0) / \left[ Ree(0) - \sum_{k=1}^{L_p} g_k R_{he}(m_k) \right], \tag{5}$$

where $R_{ee}(O)$ is representative of electric power which is concerned with the weighted error signal $e_w(n)$ appearing within each subframe.

More particularly, a first one of the signal-to-noise ratio is calculated in compliance with Equation (5) with reference to the excitation pulses determined within the first subframe. In this event, the excitation pulses in question are delayed by a decoded pitch period Pd' and repeated within the second subframe to obtain the first signal-to-noise ratio. The first signal-to-noise ratio is represented by $S/N_1$. A second one of the signal-to-noise ratios is calculated with reference to the excitation pulses which are determined within the second subframe. The second signal-to-noise ratio is represented by $S/N_2$.

A ratio R between the first and the second signal-to-noise ratio is given by:

$$R = (S/N_2)/(S/N_1). \tag{6}$$

An optimum value of the ratio R is equal to unity. This means that the same excitation pulses appear in both of the first and the second subframes. However, the excitation pulses may vary in both of the first and the second subframes. In this case, the ratio R becomes greater than unity.

Under the circumstances, the excitation pulses of the first subframe may be repeated within the second subframe when the ratio R is not greater than a predetermined threshold value Th which may be, for example, 2 or so.

At a seventh step $S_7$, the ratio R calculated in compliance with Equation (6) and thereafter compared with the predetermined threshold value Th so as to decide whether or not the excitation pulses of the first subframe are to be repeated in the second subframe. If the ratio R is not greater than the predetermined threshold value Th, the excitation pulse producing circuit 25 produces a repeat signal which is representative of a repeat or iteration of the excitation pulses appearing in the first subframe and which is specified by a single bit of "1." The repeat signal can be produced by the use of the arithmetic logic unit and is stored in the data memory.

On the other hand, the seventh step $S_7$ is followed by an eighth step $S_8$ when the ratio R is greater than the predetermined threshold value Th. At the eighth step $S_8$, the excitation pulses of each of the first and the second subframes are reduced in number to a half thereof. In other words, the excitation pulses are thinned out or subsampled in the first and the second subframes. For example, the excitation pulses of each subframe may be successively selected by $L_p/2$ in number from one of the excitation pulses that has a maximum absolute value in amplitude.

At any rate, the major group of the excitation pulses is modified into a succession of modified excitation pulses with reference to the major group of the excitation pulses.

The seventh step $S_7$ or the eighth step $S_8$ proceeds to a ninth step $S_9$ at which the variable i is further increased by one. The resultant variable i is indicative of a third one of the subframes and is compared with the subframe number Mb at a tenth step $S_{10}$. If the variable or subframe index i is smaller than Mb, the tenth step $S_{10}$ is followed by the fourth step $S_4$. Thereafter, similar operation is carried out about two adjacent ones of the subframes in the above-mentioned manner.

Otherwise, the tenth step $S_{10}$ proceeds to an eleventh step $S_{11}$ at which the excitation pulse or pulses are calculated or determined by $L_R$ in the remaining part of the frame in compliance with Equation (4). The modified excitation pulses of each frame are stored in the data memory together with the repeat signal $R_P$.

At a twelfth step $S_{12}$, the modified excitation pulses and the repeat signal are depicted at EX and $R_P$, respectively, and are produced from the excitation pulse producing circuit 25. Thus, the excitation pulse producing circuit 25 cooperates with the autocorrelator 26, the weighting circuit 32, and the cross-correlator 27 to process the digital signal sequence at each subframe into the minor groups of the excitation pulses and to determine the major group of the excitation pulses. The pitch period signal Pd is decoded into a decoded pitch period Pd' within the excitation pulse producing circuit 25.

Figure 4:
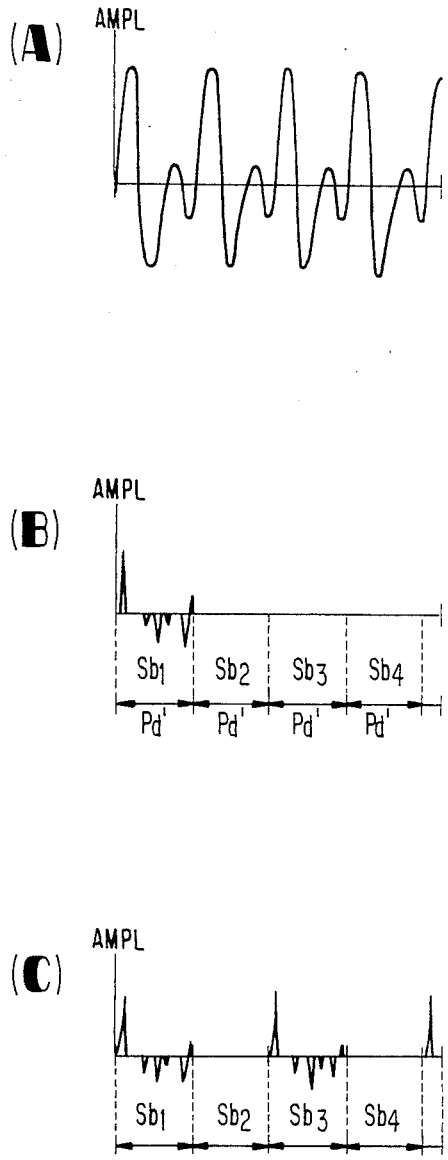
FIGS. 4(A) through (C) are time charts for use in describing operation carried out in a frame in the encoder illustrated in FIG. 1.

Referring to FIG. 4 together with FIG. 2, it is assumed that the original pattern signal has a waveform illustrated in FIG. 4(A) in a frame and is given to the encoder in the form of the digital signal sequence. The illustrated pattern signal is divided into first through fourth ones of the subframes (depicted at $Sb_1$ through $Sb_4$) with reference to the decoded pitch period Pd' at the third step $S_3$ of FIG. 2. Therefore, the number Mb of the subframes Sb is equal to four. In FIG. 4(B), a minor group of the excitation pulses is calculated within the first subframe $Sb_1$ at the fourth step $S_4$. The excitation pulses of each minor group are assumed to be equal to six in number.

In FIG. 4(C), no excitation pulses appear in the second subframe $Sb_2$. This is because the ratio R is not greater than the predetermined threshold value Th described in conjunction with the seventh step $S_7$. This means that the excitation pulses of the first subframe $Sb_1$ are repeated within the second subframe on decoding. Another minor group of the excitation pulses is calculated within the third subframe $Sb_3$ in the manner described with reference to the fourth step $S_4$. The third subframe is followed by the fourth subframe in which no excitation pulses are arranged like in the second subframe $Sb_2$.

The remaining part is left in the illustrated frame after the fourth subframe $Sb_4$. A single one of the excitation pulses is calculated in the illustrated remaining part of the frame, as shown in FIG. 4(C). Thus, thirteen excitation pulses are produced as the modified excitation pulses in the frame.

Referring back to FIG. 1, the modified excitation pulse succession EX is sent to an encoding circuit 36 for encoding the amplitude $g_k$ and the instant $m_k$ of each modified excitation pulse EX into a sequence of encoded codes depicted at EX' in FIG. 1, each time when all of the modified excitation pulses EX are determined in each frame. The encoded amplitude and the encoded instant are sent together with the repeat signal $R_P$ and the K parameter code sequence $I_m$ to the multiplexer 24 and are produced as the output code sequence OUT. Therefore, the encoding circuit 36 and the multiplexer 24 serve to produce the output code sequence OUT.

Description will be made about methods of encoding the amplitude $g_k$ and the instant $m_k$ for a while. By way of example, the amplitude $g_k$ is normalized into a normalized value by using, for example, each of the maximum ones of the amplitudes for the respective segments as a normalizing factor. The normalized value is quantized and encoded. Alternatively, the amplitude $g_k$ may be encoded by a method described by J. Max in IRE Transactions on Information Theory, March, 1960, pages 7–12, under . the title of "Quantization for Minimum Distortion." The instant $m_k$ may be encoded by the run length encoding known in the art of facsimile signal transmission. More particularly, the instant $m_k$ is encoded by representing a "run length" between two adjacent excitation pulses by a code representative of the run length. In addition, the normalizing factor may be encoded by the logarithmic companding encoding known in the art.

In the example being illustrated, the encoding circuit 36 locally decodes the encoded amplitude and instant into a decoded amplitude $g_k'$ and a decoded instant $m_k'$, respectively. The decoded amplitude $g_k'$ and the decoded instant $m_k'$ are delivered to a local pulse generator 38, together with the repeat signal $R_P$ and the pitch period signal Pd. The local pulse generator 38 produces a local reproduction of the excitation pulses in response to the decoded amplitude $g_k'$ and the decoded instant $m_k'$ of each modified excitation pulse EX and to the repeat signal $R_P$. The local reproduction of the excitation pulses is delivered to the synthesizing filter 22 operable in response to the decoded K parameters $K_m'$, namely, the decoded prediction coefficients.

The synthesizing filter 22 calculates a succession of response signals $\hat{x}(n)$ for two frames in accordance with the following equation:

$$\hat{x}(n) = d(n) + \sum_{m=1}^{M} K_m' \cdot \hat{x}(n-m), \tag{7}$$

where d(n) is identical with the local reproduction of the excitation pulses for a first one ($1 \leqq n \leqq N$) of two frames and is identical with zero for the second one ($N+1 \leqq n \leqq 2N$). The synthesizing filter 22 produces as the output sequence the response signals calculated for the second frame. The output sequence is sent to the subtractor 31 to be processed in the manner mentioned before.

Figure 5:
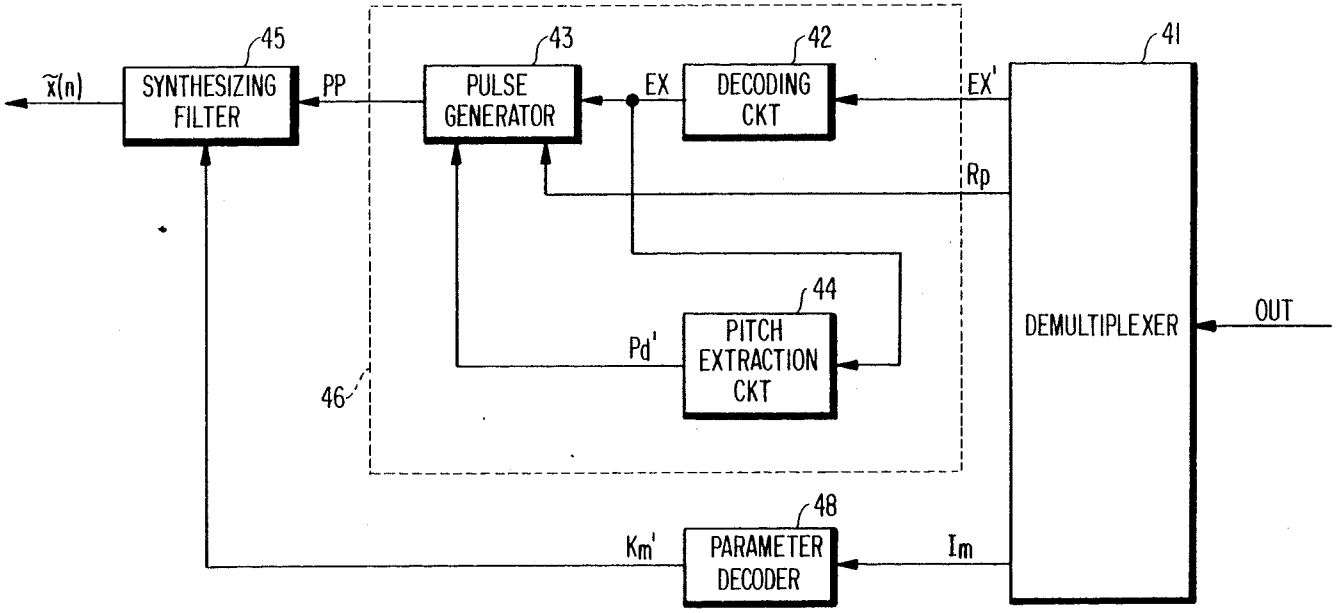
FIG. 5 is a block diagram of a decoder for use in combination with the encoder illustrated in FIG. 1.

Referring to FIG. 5, a decoder is for use in combination with the encoder illustrated with reference to FIGS. 1 through 4 and comprises a demultiplexer 41 responsive to the output code sequence OUT of the encoder. The demultiplexer 41 separates the output code sequence OUT into transmission parameters, transmission repeat signal, and transmission modified excitation pulses which correspond to the K parameter code sequence $I_m$, the repeat signal $R_P$, and the encoded codes EX', respectively, and which are therefore represented by like reference symbols, respectively. Thus, the demultiplexer 41 serves to separate the output code sequence OUT. Inasmuch as the encoded codes EX' correspond to the modified excitation pulses EX, the transmission modified excitation pulses EX' may be made to correspond to the modified excitation pulses EX.

A decoding circuit 42 decodes the transmission modified excitation pulses EX' into decoded signals which are reproductions of the modified excitation pulses EX. The decoded signals EX are delivered to a pulse generator 43 and a pitch extraction circuit 44.

The pitch extraction circuit 44 produces a reproduced pitch period signal Pd' in response to the decoded signals EX. Production of such a reproduced pitch period Pd' is possible, for example, by comparing each amplitude of the decoded signals EX with a preselected threshold level or by calculating an autocorrelation of the decoded signals EX.

Supplied with the reproduced pitch period Pd', the decoded signals EX, and the transmission repeat signal $R_P$, the pulse generator 43 is operable in a manner similar to the pulse generator 38 illustrated in FIG. 1. More particularly, the pulse generator 43 divides each frame into a plurality of subframes in a manner described in conjunction with the excitation pulse producing circuit 25 with reference to FIG. 2. Thereafter, the numbers $L_P$ and $L_R$ of the excitation pulses are determined which are to be produced in each subframe and the remaining part of each frame.

A minor group of reproduced excitation pulses is produced in each subframe with reference to the transmission repeat signal $R_P$ and both of the amplitude $g_k'$ and the instant $m_k'$ of each decoded signal EX. If the transmission repeat signal $R_P$ is indicative of the repeat of the excitation pulses in an even numbered one of the subframes, the reproduced excitation pulses of a preceding and odd numbered one of the subframes are delayed by the pitch interval or period Pd' to be repeated in the even numbered subframe. Otherwise, the reproduced excitation pulses are produced by $L_P/2$ in number in each subframe. Similar operation is carried out in all of the subframes. Finally, the reproduced excitation pulses of $L_R$ are produced in the remaining part of the frame.

Thus, a major group of the reproduced excitation pulses is sent as processed pulsed PP to a synthesizing filter circuit 45. Therefore, a combination of the decoding circuit 42, the pulse generator 43, and the pitch extraction circuit 44 will be called a processing circuit 46 for processing the transmission modified excitation pulses EX' into the processed pulses PP.

Responsive to the transmission parameters $I_m$, a parameter decoder 48 produces decoded K parameters $K_m'$ corresponding to those described with reference to FIG. 1. The decoded K parameters $K_m'$ are converted into prediction coefficients $a_k'$ in a known manner in the synthesizing filter 45. The synthesizing filter 45 produces a synthesized signal $\tilde{x}(n)$ in response to the processed pulses PP and the prediction coefficients. The synthesized signal $\tilde{x}(n)$ is produced for each frame in accordance with the following equation:

$$\tilde{x}(n) = d(n) + \sum_{k=1}^{p} a_k' \cdot \tilde{x}(n-k),$$

where n is an integer between unity and N, both inclusive and d(n) is representative of the processed pulses PP. The synthesized signal $\tilde{x}(n)$ is representative of a reproduction of the digital signal sequence x(n) supplied to the encoder illustrated in FIG. 1.

Figure 6:
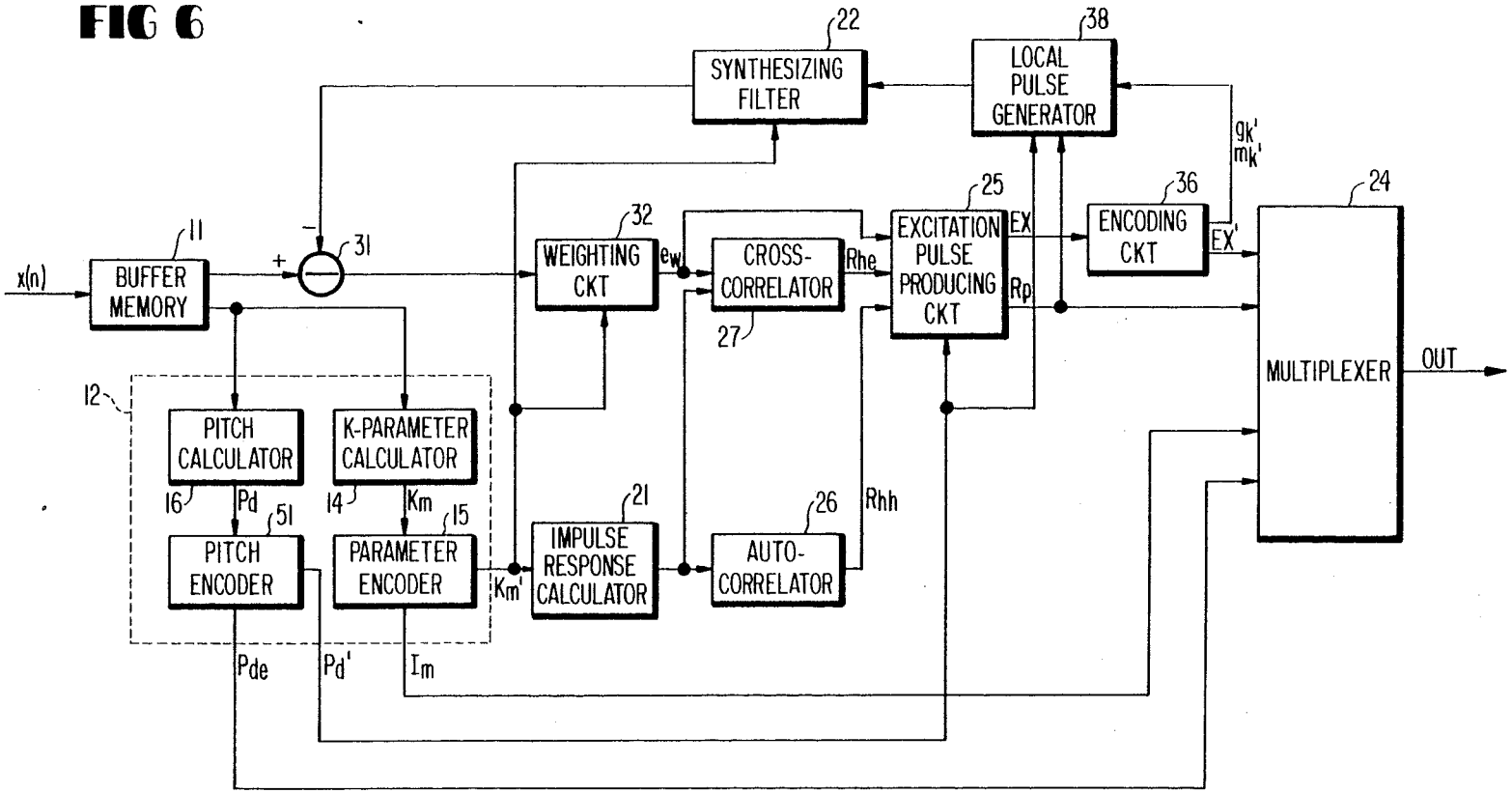
FIG. 6 is a block diagram of an encoder according to a second embodiment of this invention.

Referring to FIG. 6, an encoder according to a second embodiment of this invention is similar to that illustrated in FIG. 1 except that the pitch period or pitch parameter is combined with the encoded code sequence EX', the repeat signal $R_P$, and the K parameter code sequence $I_m$. For this purpose, the illustrated parameter calculator 12 further comprises a pitch encoder 51 operable in response to the pitch period signal Pd sent from the pitch calculator 16. The pitch encoder 51 comprises an encoding part for encoding the pitch period signal Pd into an encoded pitch signal Pde and a decoding part for decoding the encoded pitch signal Pde into a decoded pitch signal Pd'.

The decoded pitch signal Pd' is delivered to the excitation pulse producing circuit 25 and the local pulse generator 38. The excitation pulse producing circuit 25 divides each frame into a plurality of subframes by the use of the decoded pitch signal Pd' in the manner described with reference to FIG. 2 while the local pulse generator 38 produces the local reproduction of the excitation pulses by the use of the decoded pitch signal Pd'.

On the other hand, the encoded pitch signal $P_{de}$ is representative of the pitch period or parameter and is sent through the multiplexer 24 to a transmission line (not shown). Therefore, the multiplexer 24 serves to successively combine the encoded pitch signals Pde with the K parameter code sequence $I_m$, the repeat signals $R_P$, and the encoded code sequence EX'. In this event, the pitch parameters are combined with the K parameters and with the modified excitation pulses into combined parameters and combined excitation pulses, respectively. Anyway, the output code sequence carries the pitch parameters extracted from the respective segments arranged within the frames.

Figure 7:
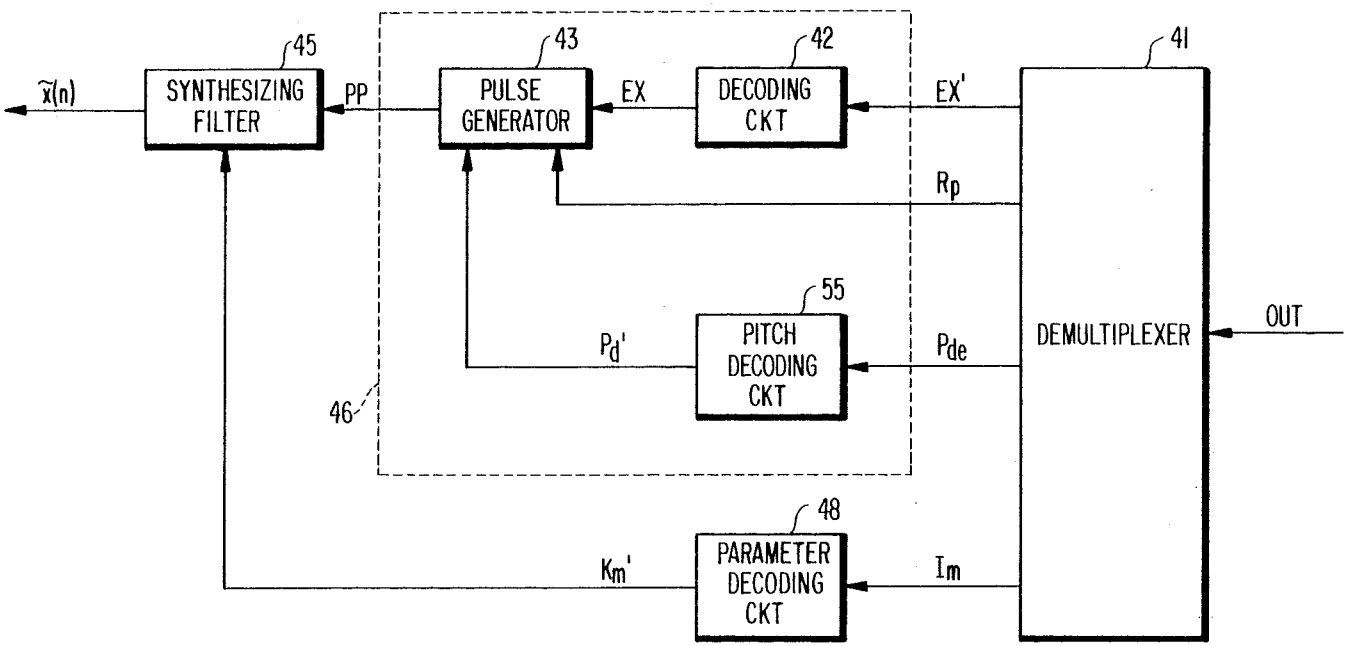
FIG. 7 is a block diagram of a decoder for use in combination with the encoder illustrated in FIG. 6.

Referring to FIG. 7, a decoder is for use in combination with the encoder illustrated in FIG. 6 and is similar to that illustrated in FIG. 5 except that the demultiplexer 41 shown in FIG. 7 is supplied with the output code sequence OUT carrying the pitch parameters and further separates the output code sequence OUT into intermediate parameter signals which correspond to the encoded pitch signals Pde and which are therefore depicted at Pde. At any rate, the intermediate parameter signals Pde are representative of intermediate parameters corresponding to the pitch parameters. This means that the demultiplexer 41 separates the output code sequence OUT into the transmission parameters $I_m$, the transmission repeat signal $R_P$, and the transmission modified excitation . pulses EX' like in FIG. 5.

In this connection, the illustrated processing circuit 46 comprises a pitch decoding circuit 55 for decoding the intermediate parameter signals Pde into a succession of reproduced pitch period signals Pd'. Thus, the pitch decoding circuit 55 is substituted for the pitch extraction circuit 44 illustrated in FIG. 5.

Like in FIG. 5, the decoding circuit 42 produces reproductions EX of the modified excitation pulses in response to the transmission modified excitation pulses EX'. Responsive to the reproductions EX of the modified excitation pulses, the transmission repeat signal $R_P$, and the reproduced pitch period signal Pd', the pulse generator 43 supplies the synthesizing filter 45 with the processed pulses PP corresponding to the excitation pulses produced in the excitation pulse producing circuit 25 (FIG. 6). The synthesizing filter 45 produces the reproduction of the discrete pattern signal in response to the decoded K parameters $K_m'$ and the processed pulses PP.

Figure 8:
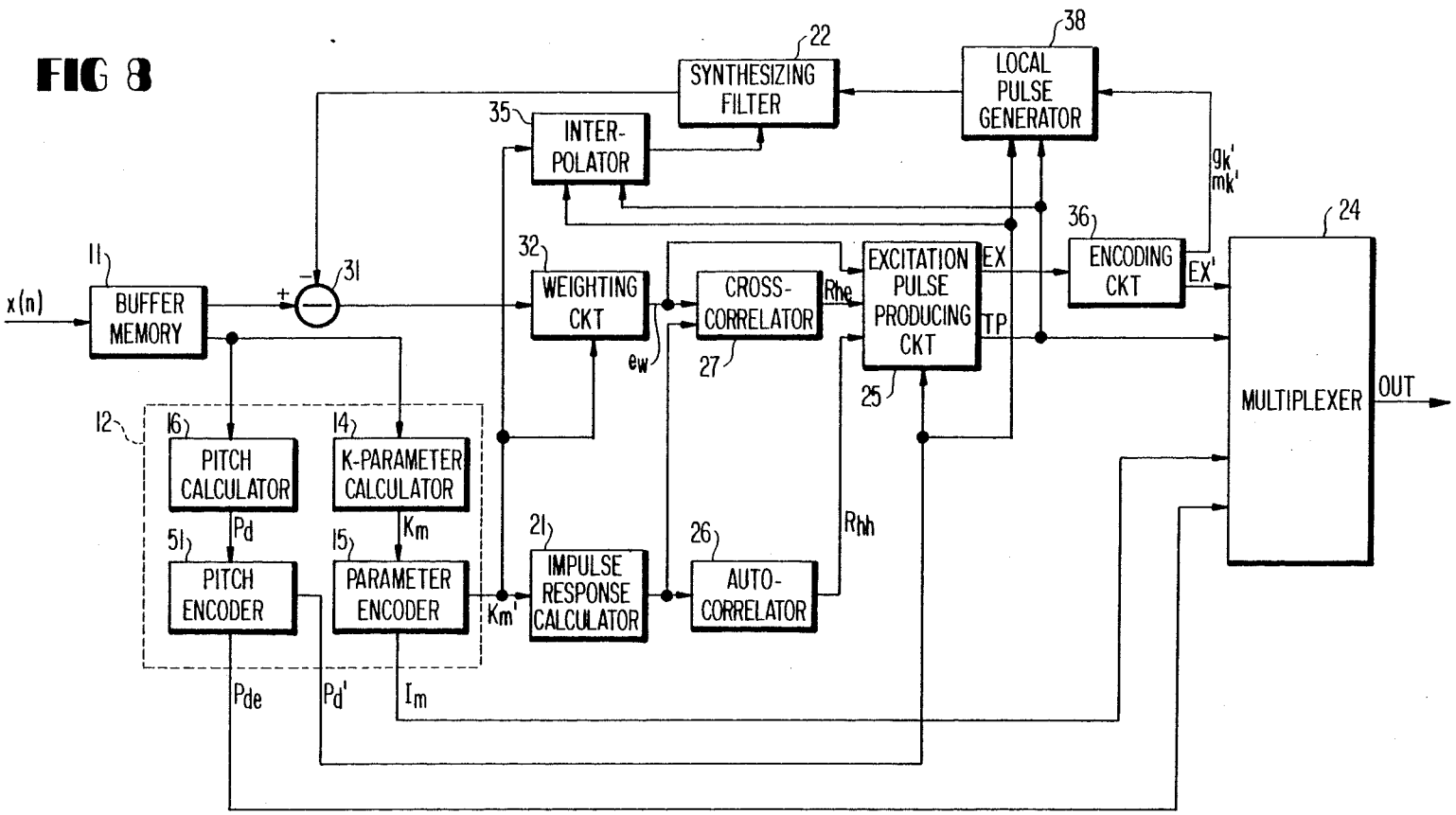
FIG. 8 is a block diagram of an encoder according to a third embodiment of this invention.

Referring to FIG. 8, an encoder according to a third embodiment of this invention is similar to that illustrated in FIG. 6 except that an interpolator 35 is used to interpolate the decoded K parameters $K_m'$ and that the excitation pulse producing circuit 25 and the local pulse generator 38 are operated in different manners.

In the excitation pulse producing circuit 25, each segment is divided into several subframes, each of which has the same interval as the decoded pitch period Pd'. The excitation pulses are calculated by the use of Equation (4) for one subframe that is located at a center of the segment. The excitation pulses are sent to the encoding circuit 36. A subframe phase $T_P$ is specified by an interval between the beginning instant of the segment and the beginning instant of the first subframe and is delivered to the encoding circuit 36.

The interpolator 35 is supplied with the decoded K parameters $K_m'$, the decoded pitch period Pd', and the subframe phase $T_P$ to linearly interpolate K parameters at each subframe by the use of the K parameters of two adjacent frames. The illustrated local pulse generator 38 is operable in response to decoded amplitudes and locations or instants of excitation pulses in one subframe, decoded pitch period Pd' and subframe phase $T_P$ so as to reconstruct the major group of the excitation pulses for each frame. This reconstruction process can be carried out using linear interpolation of each pulse.

Figure 9:
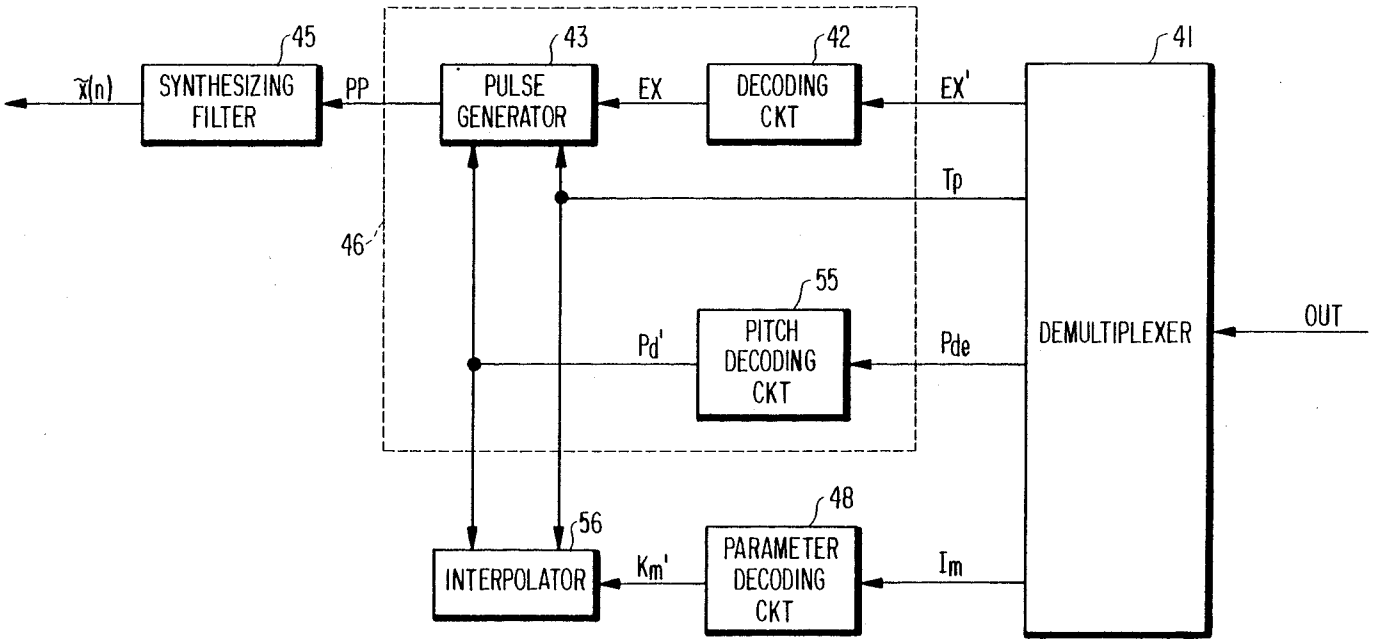
FIG. 9 is a block diagram of a decoder for use in combination with the encoder illustrated in FIG. 8.

Referring to FIG. 9, a decoder is for use in combination with the encoder illustrated in FIG. 8 and is similar to the decoder illustrated in FIG. 7 except that the interpolator 56 is used to interpolate the decoded K parameters $K_m'$ and that the pulse generator 43 is operated in a manner somewhat different from that of FIG. 7. However, the interpolator 56 and the pulse generator 43 are put into operation in the manner described in conjunction with the interpolator 35 and the local pulse generator 38 of FIG. 8 and will therefore not be described any longer.

While this invention has thus far been described in conjunction with a few embodiments thereof, it will readily be possible for those skilled in the art to put this invention into practice in various other manners. For example, the excitation pulses may be searched in a manner described by the Atal et al article referenced in the instant specification. Although the excitation pulses are successively calculated one by one by the use of Equation (4), adjustment of amplitudes may be made about preceding ones of the excitation pulses each time when a current one of the excitation pulses is calculated. Thus, any other algorithm than the algorithm specified by Equation (4) may be used to calculate the excitation pulses. For example, the Viswanathan's algorithm may be used. A reduction rate of the excitation pulses may not be restricted to ½. If the excitation pulses are always reduced at a predetermined reduction rate, the repeat signal $R_P$ may not be sent from the encoder to the decoder. In this event, the decoder may repeat the excitation pulses sent from the encoder in consideration of the predetermined reduction rate. Although the number of the excitation pulses is reduced to a half thereof in each subframe at the eighth step $S_8$ illustrated in FIG. 2, a total number of the excitation pulses arranged in two adjacent ones of the subframes may be reduced to $L_P$. In this event, the number of the excitation pulses arranged in each subframe may not be equal to $L_P/2$.

Decision of a reduction of the excitation pulses may be made by determining a total number of the excitation pulses for each frame and by successively comparing the excitation pulses produced in each subframe with the total number of the excitation pulses.

Each frame may be divided into the plurality of subframes with reference to a leading one of the excitation pulses that is placed in each frame. Specifically, a first one of the subframes begins at a start point adjacent to an instant for the leading excitation pulses. The frame is divided at the pitch interval from the start point. In this case, transmission should be made about the start point from the encoder to the decoder. To this end, an interval $T_P$ between a leading instant of each frame and the start point may be transmitted in the form of a code signal of a predetermined code length. Alternatively, a ratio between the interval $T_P$ and the pitch interval may be encoded into a specific code of a prescribed length and transmitted from the encoder to the decoder.

On recovering the removed excitation pulses, interpolation may be used in the decoder. More specifically, when no excitation pulses are placed in a specific one (j) of the subframes, the interpolation is carried out by the use of two sets of the excitation pulses derived from two adjacent subframes $(j-1)$ and $(j+1)$.

When the last one of the subframes in a frame exceeds the frame in question with a first part left in the frame and with a second part left in the following frame, division may be carried out over a plurality of the frames to form the subframes. In this case, a reduction of the excitation pulses may also be continuously carried out over the plurality of the frames. The plurality of the frames may be called the spectral interval. Alternatively, the reduction of the excitation pulses may be individually carried out at every frame as follows. At first, the excitation pulses in the first part of the last subframe are reduced in a current one of the frames. Thereafter, the excitation pulses in the second part of the last subframe are reduced in the following frame.

If voiced and unvoiced sounds are detected as regards the speech signal at every frame, the reduction of the excitation pulses may be made about each frame including the voiced sounds. Detection between the voiced and the unvoiced sounds is possible by carrying out calculation by the use of an autocorrelation function or a covariance function as regards the speech signal or the error signal.

Inasmuch as the autocorrelation function of the impulse response corresponds to a power spectrum which can be calculated by the use of the decoded K parameters, as known in the art, the power spectrum may at first be calculated from the decoded K parameters and the autocorrelation function may thereafter be calculated by the use of the correspondence between the power spectrum and the autocorrelation function of the impulse response.

On calculation of the cross-correlation function between the weighted error signals $e_w(n)$ and the weighted impulse response sequence $h_w(n)$ in FIGS. 1 and 6, a cross-power spectrum may be used because the cross-power spectrum corresponds to the cross-correlation function, as described by A. V. Oppenheim et al in "Digital Signal Processing" (Chapter 8). The above-mentioned cross-correlation function may be calculated after a cross-power spectrum is calculated by the use of the weighted error signals $e_w(n)$ and the decoded K parameters $K_m'$.

The encoding circuit 36 illustrated in FIGS. 1 and 6 may encode each of the modified excitation pulses EX into the encoded code one by one. With this structure, it is possible to obtain excitation pulses such that any errors become minimum.

On deciding the pitch period signal Pd' in the pitch extraction circuit 44 illustrated in FIG. 5, the pitch period may be detected from a relative distance between the reproduced excitation pulses of large amplitudes when relative instants of the excitation pulses are transmitted from the encoder.

What is claimed is:

1. A method of encoding a discrete pattern signal into an output code sequence and of decoding said output code sequence into a reproduction of said discrete pattern signal, said discrete pattern signal including pitch pulses and being composed of a succession of segments, said method comprising the steps of:

extracting, from said discrete pattern signal, a pitch parameter representative of a pitch period of said pitch pulses and a spectral parameter specifying short time spectrum envelope characteristics of said discrete pattern signal;

dividing each of said segments into a succession of subframes each of which has a length equal to the pitch period determined by the pitch parameter;

calculating excitation pulses for a first subframe;

calculating excitation pulses for a second subframe following said first subframe;

calculating first and second signal-to-noise ratios for said first and second subframes, respectively;

determining a ratio R of said second signal-to-noise ratio to said first signal-to-noise ratio;

comparing the ratio R to a predetermined threshold value Th;

generating a repeat signal for the second subframe when the ratio R is not greater than the threshold value Th, so as to repeat the excitation pluses of the first subframe for the second subframe, and otherwise generating modified excitation pulses calculated from the first and second subframes, the excitation pulses of the first subframe and the modified excitation pulses being produced as practical excitation pulses;

producing said output code sequence which is obtained by encoding said spectral parameter, said repeat signal, and the practical excitation pulses;

separating said output code sequence into the spectral parameter, the practical excitation pulses, and the repeat signal;

decoding the practical excitation pulses for said at least one subframe in said subframes within each of said segments to produce decoded excitation pulses when the practical excitation pulses are given and to produce reconstructed excitation pulses by the use of said repeat signal and said decoded excitation pulses when said repeat signal is given; and producing a reconstructed discrete pattern signal for each of said segments by the use of said decoded and said reconstructed excitation pulses and said spectral parameter.

2. A method as claimed in claim 1, wherein said reconstructed discrete pattern signal producing step comprises the steps of:

extracting a reproduction of said pitch parameter from said decoded excitation pulses; and using said reproduction of the pitch parameter to divide said segment into said subframes and produce said reconstructed discrete pattern signal by repeating said decoded excitation pulses as said reconstructed excitation pulses in the subframes within each of said segments when repetition of said decoded excitation pulses is indicated by said repeat signal.

3. An encoder for encoding a discrete pattern signal into an output code sequence, said discrete pattern signal including pitch pulses and being composed of a succession of segments, said encoder comprising:

extracting means for extracting, from said discrete pattern signal, a pitch parameter representative of a pitch period of said pitch pulses in each of said segments of said discrete pattern signal and a spectral parameter specifying short time spectrum envelope characteristics of said discrete pattern signal;

calculating means for successively calculating excitation pulses for a first subframe and excitation pulses for a second subframe following said first subframe;

calculating means for calculating first and second signal-to-noise ratios for the first and second subframes, respectively;

determining means for determining a ratio R of said second signal-to-noise ratio to said first signal-to-noise ratio;

comparing means for comparing the ratio R to a predetermined threshold value Th;

generating means for generating a repeat signal for the second subframe when the ratio, R, is not greater than the threshold, Th, so as to repeat the excitation pulses of the first subframe for the second frame, and otherwise generating modified excitation pulses calculated from the first and second subframes, the excitation pulses of the first subframe and the modified excitation pulses being produced as practical excitation pulses which are specified by amplitudes and locations;

calculating means for calculating said amplitudes and said locations of the practical excitation pulses; and signal producing means for combining said amplitudes and said locations of the excitation pulses and said spectral parameter to produce said output code sequence.

4. An encoder as claimed in claim 3, wherein said signal combining means includes means for combining said pitch parameter and said repeat signal with said amplitudes and said locations of the excitation pulses to produce said output code sequence.

5. A decoder for decoding an encoded discrete pattern signal in the form of an output code sequence which includes amplitudes and locations of excitation pulses, a repeat signal, a pitch parameter and a spectral parameter of each segment of said encoded discrete pattern signal, said repeat signal being produced in consideration of signal-to-noise ratios between two adjacent subframes obtained by dividing each segment, said decoder for decoding said output code sequence into a reproduction of said discrete pattern signal, said decoder comprising:

separating means for separating said output code sequence into said spectral parameter, said repeat signal, and the amplitudes and locations of said excitation pulses; and producing means for producing said reproduction of said encoded discrete pattern signal by the use of said spectral parameter, said pitch parameter, said repeat signal, and the amplitudes and locations of said excitation pulses.

6. A decoder as claimed in claim 5, wherein said producing means comprises:

first local decoding means for decoding the amplitudes and locations of said excitation pulses, said pitch parameter, said repeat signal, and said spectral parameter, and second local decoding means for decoding said excitation pulses into the reproduction of said encoded discrete pattern signal by dividing each of said segments into subframes each of which has a length equal to a pitch period determined by said pitch parameter, by generating the excitation pulses for the at least one subframe in each of said segments, and by repeating the excitation pulses in other subframes except said at least one subframe within each of said segments as a reconstructed excitation signal when said repeat signal indicates repetition of the excitation pulses.

7. A decoder as claimed in claim 6, wherein said producing means includes means for producing said reproduction of said discrete pattern signal by the use of said spectral parameter and said reconstructed excitation signal.

* * * * *

UNITED STATES PATENT AND TRADEMARK OFFICE

CERTIFICATE OF CORRECTION

PATENT NO. : 4,945,565

DATED : July 31, 1990

INVENTOR(S) : Kazunori Ozawa et al.

It is certified that error appears in the above-identified patent and that said Letters Patent is hereby corrected as shown below:

Title page:

Abstract, line 21, delete "mofified" and insert --modified--.

Column 1, line 57, delete "Ozawi" and insert --Ozawa--.

Column 4, line 62, delete "VM" and insert --$V_M$--.

Signed and Sealed this

Third Day of September, 1991

*Attest:*

HARRY F. MANBECK, JR.

*Attesting Officer*

*Commissioner of Patents and Trademarks*